United States Patent [19]

Berryhill

[11] 4,386,599

[45] Jun. 7, 1983

[54] FIREPLACE STOVE

[75] Inventor: Robert A. Berryhill, Greensboro, N.C.

[73] Assignee: Austin-Berryhill Fabricators, Inc., Greensboro, N.C.

[21] Appl. No.: 60,501

[22] Filed: Jul. 25, 1979

[51] Int. Cl.[3] ..... F24C 15/30

[52] U.S. Cl. ..... 126/126; 126/58; 126/131

[58] Field of Search ..... 126/121, 126, 58, 131, 126/129

[56] References Cited

U.S. PATENT DOCUMENTS

| | | | |
|---|---|---|---|
| D. 199,656 | 11/1964 | Rogers et al. | D81/19 |
| D. 243,242 | 2/1977 | Antone | D23/93 |
| D. 244,136 | 4/1977 | Buckner | D23/107 |
| D. 250,204 | 11/1978 | Turner | D23/197 |
| 746,002 | 12/1903 | Brand | 126/129 |
| 3,685,506 | 8/1972 | Mouat | 126/121 |
| 3,880,139 | 4/1975 | Young | 126/121 |
| 3,952,721 | 4/1976 | Patterson | 126/121 |
| 4,166,444 | 9/1979 | Martenson | 126/121 |
| 4,169,458 | 10/1979 | Shaw | 126/121 |
| 4,174,700 | 11/1979 | Bartsch | 126/131 |
| 4,179,065 | 12/1979 | Zung | 126/121 |

*Primary Examiner*—James C. Yeung

*Attorney, Agent, or Firm*—Cushman, Darby & Cushman

[57] ABSTRACT

A woodburning stove adapted to be inserted into a fireplace having inner walls operatively forming a fire chamber and outer walls spaced from the inner walls to form air heating chambers through which air to be heated is forced by a fan disposed beneath the fire chamber adjacent to the front face of the stove. The inner walls are arranged to channel air beneath, behind, on top of and to the sides of the fire chamber in successive order before discharge out the front of the stove. A special fire chamber and flue means cause the hot exhaust gases of the fire chamber to flow along the rear and top walls of the fire chamber and through a damper in the front of the stove and into a flue chamber before flowing into the fireplace flue. The temperature of a heating surface disposed on top of the flue chamber above the damper is controlled by damper control means at the front wall of the stove.

14 Claims, 7 Drawing Figures

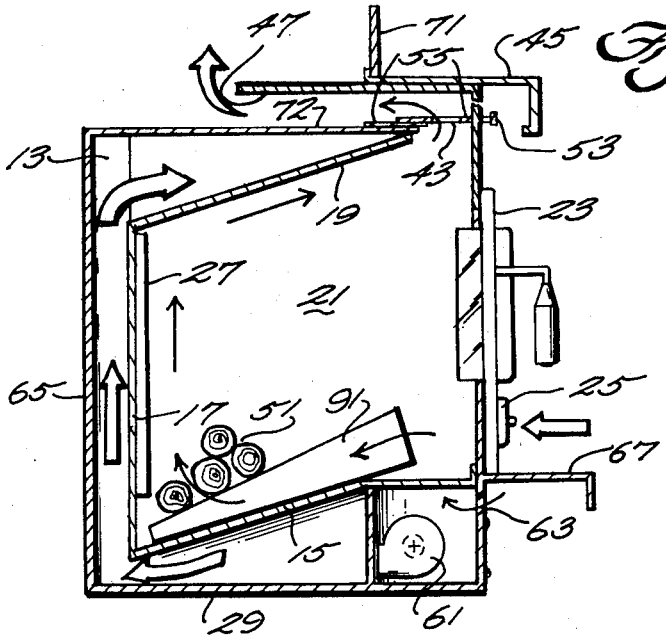
Fig. 2
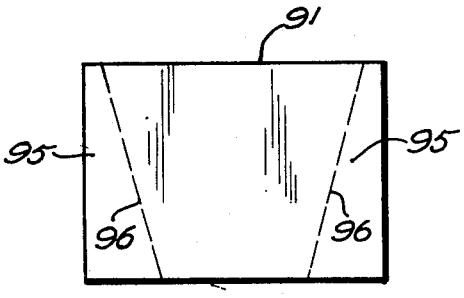
Fig. 5
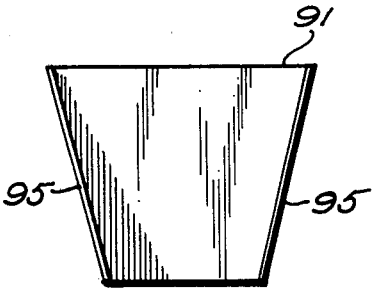
Fig. 6
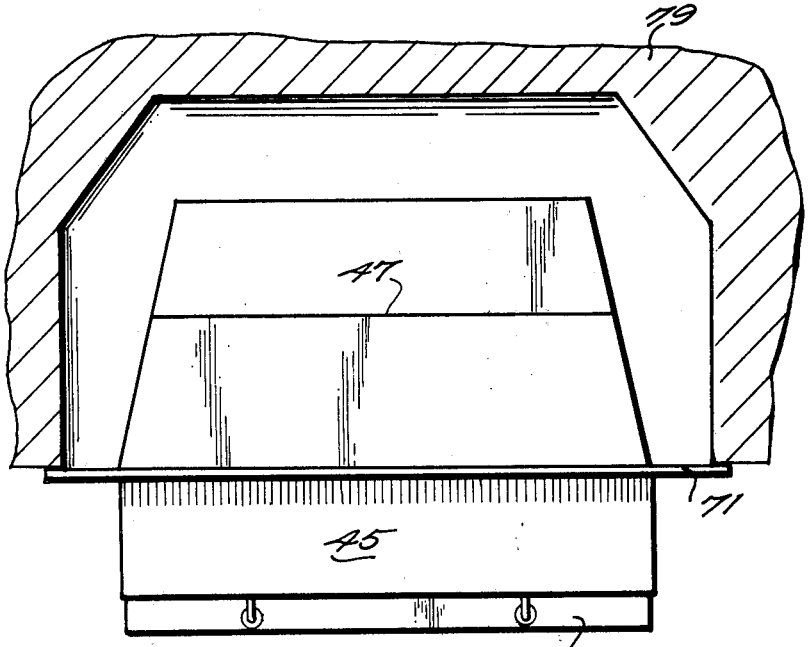
Fig. 4
Fig. 7
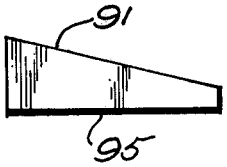

FIREPLACE STOVE

BACKGROUND OF THE INVENTION

The invention relates to coal or woodburning stoves and, more particularly, to such stoves having an inner fire chamber and a surrounding air heating space, the stove being insertable in a fireplace and usable for cooking and space heating.

Stoves which may be inserted in a preexisting fireplace are well known. The exterior design of such stoves is illustrated in Design patents Des. No. 244,136 issued to Buckner, Des. No. 250,204 issued to Turner, and Des. No. 199,656 issued to Rogers. Woodburning stoves which are usable for cooking and space heating are also well known. Such a stove is disclosed in U.S. Pat. No. 3,952,721 issued to Patterson.

High heat production efficiency has long been recognized as an important feature of space heaters. Coal and woodburning stoves have long been used for space heating but their efficiency has been far from optimum because a substantial portion of the heat produced has been lost through hot gases flowing out of the stove's flue pipe. A recently developed approach to increasing the space heating efficiency of coal and woodburning stoves has been to surround the heat conductive walls of the fire chamber with spaced outer walls and to circulate room air through the space between the fire chamber walls and the outer walls so that heat generated in the fire chamber is transferred through the fire chamber walls to the circulating room air as the air passes over the walls. However, prior stoves designed in accordance with this approach channel the circulating air over only a limited surface area of the fire chamber and therefore limit the amount of heat which may be transferred to the circulating air. U.S. Pat. No. 3,952,721 issued to Patterson discloses such a stove. In the Patterson stove, air flows into the air heating space through holes at the side of the bottom plate of the stove. The air then circulates upwardly along the side and back of the stove, upward to the top of the stove and across the top of the stove through the front vents. The air is thus heated from within the fire chamber along the side walls, a portion of the back wall and over the top wall of the fire chamber. Flue gases escape from the fire chamber through a vertical flue disposed at the back portion of the stove.

It is well known that air blowers, such as, electric fans, can also be utilized in coal and woodburning stoves to increase the volume of air circulated in the space surrounding the fire chamber to thereby increase the efficiency of heat transfer. Prior stoves utilizing such electric fans were generally arranged with the fans located in the rear or near the top of the stove. These arrangements have the disadvantage of subjecting the fans to the intense heat which normally develops at these locations which can result in overheating of the fan motor and electric wiring. The fan shown in U.S. Pat. No. 3,685,506 issued to Monsat, for example, is disposed near the top of the stove in an open space surrounding the inner fire chamber where the air is normally very hot and could cause overheating of the fan motor and electric wires.

Accordingly, an object of the present invention is to provide a space heating and cooking stove which has increased heating efficiency and reliability.

SHORT STATEMENT OF THE INVENTION

Accordingly, the present invention relates to a stove capable of being readily inserted into an existing fireplace. The stove includes an inner fire chamber and an outer enclosure. The walls of the outer enclosure are spaced with respect to the walls of the fire chamber to permit passage of room air over and about the fire chamber. The bottom wall of the fire chamber is sloped downwardly from front to back to keep ashes and the logs from falling into the room when the door to the fire chamber is opened. In addition, the top wall of the fire chamber is sloped upwardly from back to front to cause the hot exhaust gases in the fire chamber to flow upwardly along the back and top walls of the fire chamber and to cause maximum heat transfer to the room air. Room air is drawn into the outer enclosure under the fire chamber by means of a fan. The air thus drawn into the enclosure, is forced under the fire chamber, to the back of its enclosure, upwardly along the back wall of the fire chamber, and over the top of the fire chamber. The room air is then forced downwardly along the side walls of the fire chamber and outwardly into the room through side vents.

The hot exhaust gases from the fire chamber not only heat the room air as they pass over and under the walls of the fire chamber, but also, further heat the room air because the hot gases are passed over a heat transfer plate at the top of the outer enclosure before being passed upwardly through the flue.

In accordance with another feature of the invention, the stove includes an andiron, disposed on the fire chamber bottom wall, which is specially designed from a single rectangular sheet of metal to improve the draft into the fire chamber and permit slow burning of logs in the rear of the fire chamber. In accordance with this aspect of the invention, the sides of the andiron are bent upward along converging straight lines in order to obtain andiron side walls which increase in height as the lines converge. By inserting the andiron in the fire chamber with the higher andiron side ends disposed toward the front of the chamber, the logs tend to roll or move to the rear of the fire chamber as burning proceeds. This permits relatively large draft at the front of the fire chamber where the new logs are placed and relatively small draft at the rear of the fire chamber where the logs are already burning hot.

In accordance with another important feature of the invention, the fan motor is positioned beneath the fire chamber so that the motor is maintained cool. Should the power fail, a thermal draft causes cool air to flow past the motor to maintain it relatively cool.

BRIEF DESCRIPTION OF THE DRAWINGS

Further objects, features and advantages of the invention will become more fully apparent from the following detailed description of the preferred embodiment and the accompanying drawings in which:

FIG. 2 is a side sectional elevation view of the stove taken along line 2—2 of FIG. 1 with an andiron placed on the fire chamber thereof;

FIG. 4 is a plan view of the stove of FIG. 1 shown positioned in a fireplace;

FIG. 5 is a plan view of an andiron in accordance with the present invention;

FIG. 6 is a plan view of the andiron illustrated in FIG. 5; and

FIG. 7 is a side elevation of the andiron of FIGS. 5 and 6.

DETAILED DESCRIPTION OF THE PREFERRED EMBODIMENT

Figure 1:
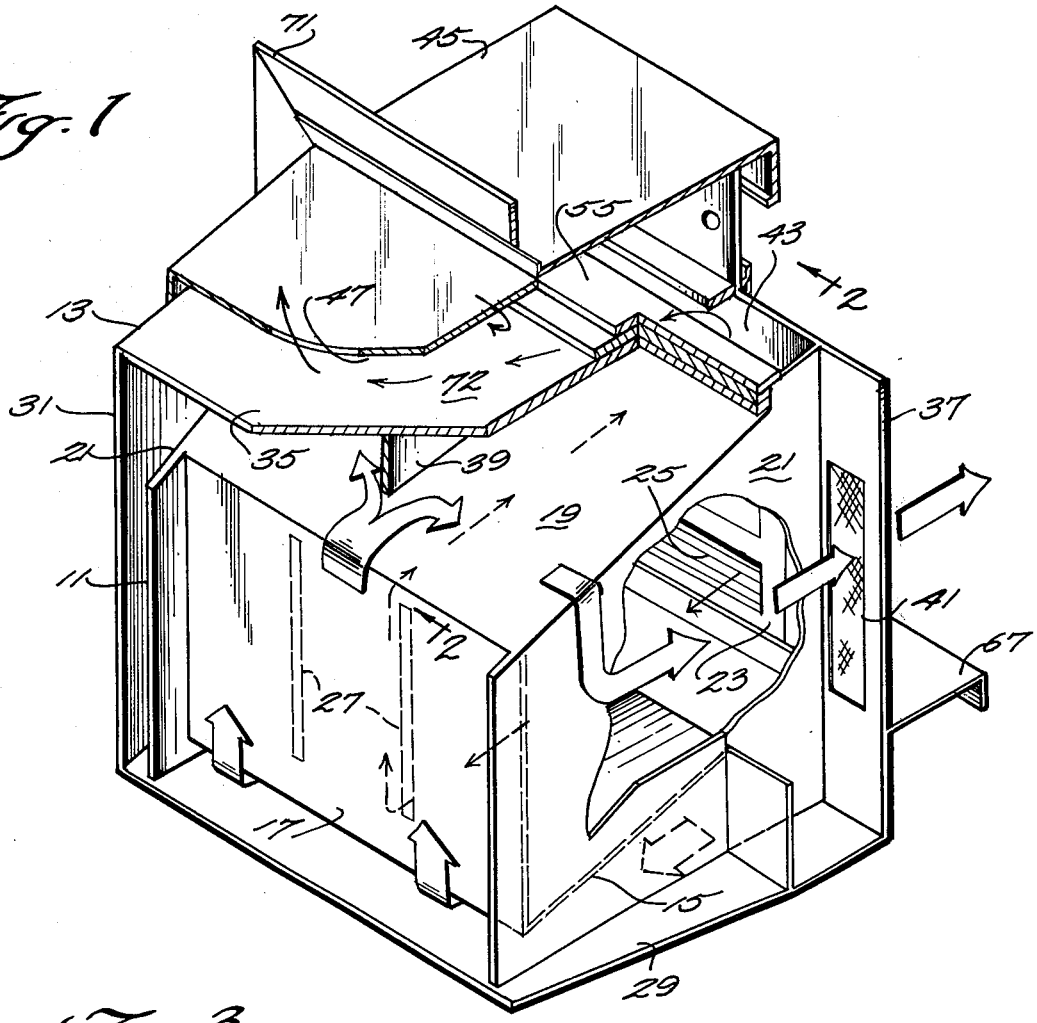
FIG. 1 is a perspective view of the preferred embodiment of the stove of the present invention with portions cut away for clarity.

Refer now to FIG. 1 where there is shown a preferred embodiment of the stove of the present invention having dimensions suitable for sliding into a preexisting fireplace. The stove includes an inner fire chamber 11 surrounded by an outer enclosure 13. The inner fire chamber is formed of a downwardly sloping bottom wall 15, a rear wall 17, a top wall 19 which slopes upwardly from back to front and a pair of side walls 21. The front of the fire chamber has a door 23 with a vent 25 therein for permitting oxygen to pass inwardly to the fire within the chamber.

The bottom wall 15 is sloped downwardly from front to back in order to permit ashes formed within the fireplace to gravitate toward the back wall 17 so that when the door 23 is opened, the ashes will not fall into the room being heated by the stove. In addition as logs are burned within the fire chamber they will tend to move toward the back wall 17 to thereby prevent an accidental movement of the logs into the room heated by the fire stove. The rear wall 17 of the stove has a pair of bar members 27 positioned thereon to space the logs within the first chamber 11 with respect to the wall 17. This permits the flow of hot exhaust gases upwardly along the rear wall 17 and along the top wall 19.

As illustrated the outer enclosure 13 is formed of a bottom plate 29 having side walls 31 extending upwardly therefrom to join with the top of the stove 35 which also forms a baffle for the exhaust gases. The back plate of the stove is not shown but is secured to both the side walls 31 of the outer enclosure and the side walls 21 of the fire chamber. The front of the outer enclosure includes a pair of end sections 37 which connect the side walls 31 of the outer enclosure to the side walls 21 of the fire chamber.

With this structure air is drawn in through a vent below the door 23 to the fire chamber and moves along the underside of bottom surface 15 of the fire chamber. The air then passes up along end wall 17 of the fire chamber and upwardly over the top surface 19 thereof. A vertical baffle 39 helps to provide an even distribution of the heated air outwardly toward the side walls of the outer enclosure and down along the side walls 21 of the fire chamber 11 where the heated gases are then passed through vents 41 into the room being heated. By this arrangement the room air is forced to traverse a maximum surface area of the fire chamber to thereby maximize the heat transfer from the fire chamber to the room air before the air is passed back into the room.

In order to improve the room air flow, a motor driven fan is positioned under the bottom plate 15 of the fire chamber to draw air from the room into the region between the fire chamber and the outer enclosure. The motor driven fan which is illustrated in FIG. 2 is positioned at the bottom of the fire chamber in order to place it in a relatively cool position within the stove to thereby increase the reliability and longevity of the motor. Further, should the motor for some reason fail or not be operating, the draft caused by the flow of hot room air upwardly and over the fire chamber will tend to cool the motor so that the motor does not become damaged while not in use.

Turning now back to FIG. 1 there is shown a flue aperture 43 located toward the front of the fire chamber and which permits the escape of hot exhaust gases from the fire chamber into a region 72 between the outer enclosure and a horizontal panel 45 which may serve as a cooking surface. The hot gases thus heat this surface 45 to permit the transfer of the heat from the fire chamber to appropriate cooking utensils. The exhaust gases are then passed along the baffle 72 and upwardly through aperture 47 to the chimney. The gases which are forced to flow into the baffle region 72 serve to further heat the room air passing underneath the baffle plate 72.

Refer now to FIG. 2 which is a side section view of FIG. 1 taken along the line 2—2 thereof. As illustrated in FIG. 2, the fire chamber 11 is formed of a bottom plate 15 which slopes downwardly from front to rear to permit ashes and logs within the fire place to move toward the back wall 17. The back wall 17 is shown having spacer bars 27 secured thereto to prevent the logs 51 from resting thereagainst and accordingly permits the flow of hot exhaust gases along the rear wall 17. Upper wall 19 is shown sloping upwardly from rear to front in order to channel the hot exhaust gases in the fireplace upwardly along the wall 19 to the flue aperture 43. This increases the heat transfer from the fire chamber to the room air passing over the top of the wall 19. Also as illustrated the flue control rod 53 is operable to move a flue plate 55 to control the flow of exhaust gases from the fire chamber upwardly into the baffle region 72.

The exhaust gases after passing through the flue aperture 43 impinge upon horizontal plane 45 to thereby heat plate 45. This plate serves as a cooking surface. The exhaust gases are then channeled into the baffle region 72 and upwardly through aperture 47 into the chimney.

The outer enclosure is spaced with respect to the fire chamber to permit the flow of room air in and about the fire chamber to thereby permit the transfer of heat from the fire chamber to the room air. This is effected by drawing air by means of a fan 61 through a bottom vent 63 into the region beneath the bottom plate 15 of the fire chamber. The room air is then forced upwardly between the wall 17 of the fire chamber and the rear wall 65 of the outer enclosure where the room air is heated. The heated room air is then passed upwardly along the top surface 19 of the fire chamber below the baffle plate 72. The heated air is then forced downwardly over the sides 21 of the fire chamber and outwardly through vents 41 (illustrated in FIG. 1) and into the room.

As illustrated in FIG. 2 the front of the stove includes a hearth plate 67 upon which debris from the fireplace can rest instead of falling into the room. A damper 25 is part of the door 23 and permits the ingress of room air into the fire chamber to fuel the fire therein. The front of the stove also includes a switch 69 for turning on and off the fan motor 61. The stove also includes a decorative front plate 71 which serves to cover the space between the stove and the pre-existing fireplace.

Figure 3:
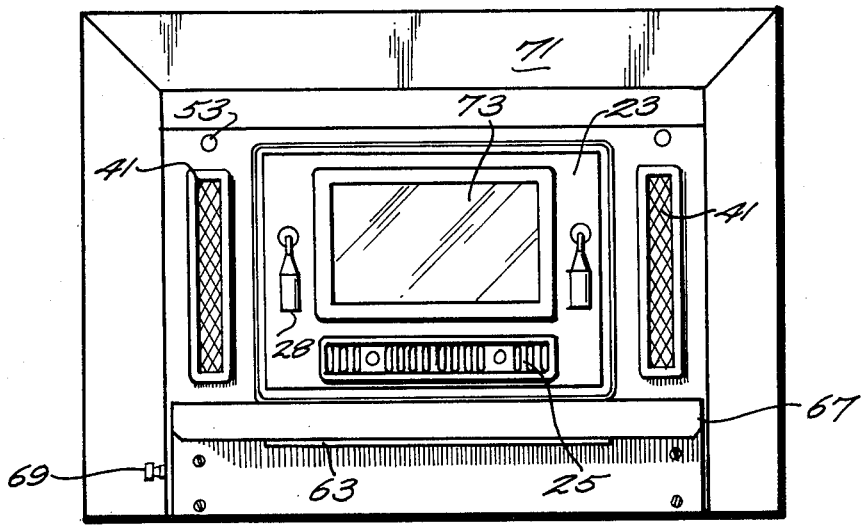
FIG. 3 is a front elevation view of the stove shown in FIG. 1.

Refer now to FIG. 3 which is a front elevation view of the stove of the preferred embodiment of the present invention.

Door 23 is illustrated positioned in the center of the front surface of the fireplace and is opened by grasping handle 28 and pulling outwardly. Preferably a window 73 is positioned in the door 23 in order to permit viewing of the fireplace so that should the fire become either too hot or too cool appropriate adjustment can be made by operation of the damper lever 53 or front vent 25. To the side of the front door 27 are illustrated the vents 41 for passing the heated room air out into the space being heated. This air is drawn into the fireplace via a bottom vent 63. The decorative plate 71 is shown extending around the front of the fireplace for the purpose of covering the space between the stove and fireplace.

Refer now to FIG. 4 which is a plan view of the stove of the present invention showing the stove as positioned in a pre-existing fireplace. The fireplace is illustrated by the shaded lines 79 and the stove is shown positioned with the decorative plate 71 positioned against the fireplace 79. The cooking plate 45 is shown extending forwardly of the fireplace and the chimney aperture for the stove 47 is shown positioned inwardly of the front surface of the pre-existing fireplace.

In accordance with another aspect of the present invention a special andiron 91 is illustrated in FIGS. 5, 6 and 7. The andiron is disposed in the fire chamber on the bottom plate 15 thereof as illustrated in FIG. 2. The andiron is so positioned so as to improve the draft of fresh air underneath the logs 51 in a fireplace thereby increase the rate of combustion thereof. Andiron 21 is suitably fabricated from a single rectangular sheet of iron 93 as illustrated in FIG. 5 by bending end portions 95 along the dotted lines to form the andiron illustrated in plan view in FIG. 6. More specifically, the andiron is formed by bending the end portions 95 along the converging lines 96 to form the andiron sides. When the andiron is properly inserted in the fireplace. The sides 95 slope downward toward the rear of the fire chamber so that the draft in the rear of the fire chamber is diminished thereby permitting the lower rear logs to burn at a slower rate.

While only a preferred embodiment of the invention has been disclosed in detail it should be understood that other obvious modifications of the invention may be made within the spirit and scope of the invention as defined by the appended claims.

What is claimed is:

1. A stove for insertion as a unit into an existing fireplace, said stove having a fan positioned in an air space therein for forcing air in heat exchange relationship with said stove and wherein said fan is located in said air space to prevent fan burn-out, said stove comprising:

a fire chamber adapted for combusting fuel, said chamber having a pair of sidewalls, top and bottom walls, an end wall and a door opposite said end wall, said door being in a frontal portion of said stove and said walls forming heat exchange surfaces, said bottom wall of said fire chamber sloping downwardly from the frontal portion of said stove to said end wall;

a frame positioned about said fire chamber and being spaced from said side, end, top and bottom walls of said fire chamber, said frame and fire chamber defining an air space therebetween;

an air inlet formed in said frame at the frontal portion of said stove for passing air from the exterior of said stove to said air space;

a fan disposed in said air space in front of and below said fire chamber for forcing air through said air space in a heat exchange path along the bottom, end and top walls of said fire chamber, said air being thereby heated, said fan being positioned in a relatively cool portion of said air space and wherein convection air flow in said air space causes cool air from said inlet to flow about said fan, along said end wall and over said top wall to thereby prevent fan burn-out due to heat from said fire chamber; and an air outlet positioned in a frontal portion of said stove for passing said heated air from said air space to the exterior of said stove.

2. A stove for insertion as a unit into an existing fireplace, said stove having a fan positioned in an air space therein for forcing air in heat exchange relationship with said stove and wherein said fan is located in said air space to prevent fan burn-out, said stove comprising:

a fire chamber adapted for combusting fuel, said chamber having a pair of sidewalls, top and bottom walls, an end wall and a door opposite said end wall in the frontal portion of said stove, said walls forming heat exchange surfaces, said bottom wall of said fire chamber sloping downwardly from the frontal portion of said stove to said end wall;

a frame positioned about said fire chamber and being spaced from said side, end, top and bottom walls of said fire chamber, said frame and fire chamber defining an air space therebetween;

an air inlet formed in said frame below said fire chamber for passing air from the exterior of said stove to said air space;

a fan disposed in said air space in front of and below said fire chamber for forcing air through said air space in a heat exchange path along the bottom, end and top walls of said fire chamber, said air being thereby heated, said fan being positioned in a relatively cool portion of said air space and wherein convection air flow in said air space causes cool air from said inlet to flow about said fan, along said end wall and over said top wall to thereby prevent fan burn-out due to heat from said fire chamber; and an air outlet positioned at least along the sides of said fire chamber in a frontal portion of said stove for passing said heated air from said air space to the exterior of said stove.

3. The stove of claim 1 or 2 further comprising vertical strips fixedly positioned on the inside of said fire chamber on the end wall thereof for keeping the fuel in said stove from abutting said end wall and blocking flames in said fire chamber from following said end wall to said top wall.

4. The stove of claims 1 or 2 wherein said stove further comprises a flue chamber extending over the top of said frame, said flue chamber having an inlet communicating with said fire chamber and an outlet communicating with a chimney of said existing fireplace, the hot exhaust gases from said fire chamber passing along the top surface of said frame and into said chimney through said outlet.

5. The stove of claim 4 wherein said flue chamber has a flat horizontal portion in heat exchange communication with the exterior of said stove, said flat horizontal portion adapted to support cooking hardware.

6. The stove of claim 4 wherein said flue chamber has a flat horizontal portion in heat exchange communication with the exterior of said stove, said flat horizontal portion being positioned opposite to and spaced from said flue inlet to permit said hot exhaust gases to impinge thereon, and being adapted to support cooking hardware.

7. A stove for insertion as a unit into an existing fireplace, said stove having a fan positioned in an air space therein for forcing air in heat exchange relationship with said stove and wherein said fan is located to prevent fan burn-out, said stove comprising:

a fire chamber adapted for combusting fuel, said chamber having a pair of sidewalls, top, bottom and end walls and a door opposite said end wall in the frontal portion of said stove, said walls forming heat exchange surfaces, said bottom wall sloping downwardly from the frontal portion of said stove to the end wall thereof;

a frame spaced from said side, end, top and bottom walls of said fire chamber, said frame and fire chamber defining an air space therebetween;

an air inlet formed in said frame in the frontal portion of said stove for passing air from the exterior of said stove into said air space;

a fan disposed in said air space in front of and below said fire chamber for forcing air through said air space in heat exchange communication with at least the bottom, end and sidewalls of said fire chamber, said air being thereby heated, said fan being positioned in a relatively cool portion of said air space and wherein convection air flow in said air space causes cool air from said inlet to flow about said fan, along said end wall and over said top wall to thereby prevent fan burn-out due to heat from said fire chamber; and an air outlet positioned in a frontal portion of said stove for passing said heated air from said air space to the exterior of said stove.

8. The stove of claim 7 wherein said air passes sequentially in heat exchange relationship along the bottom, end, top and sidewalls of said fire chamber.

9. The stove of claim 8 wherein said top wall of said fire chamber slopes upwardly from the end wall thereof to the frontal portion of said fire chamber.

10. A stove, said stove having a fan positioned in an air space therein for forcing air in heat exchange relationship with said stove and wherein said fan is located to prevent fan burn-out, said stove comprising:

a fire chamber adapted for combusting fuel, said chamber having a pair of sidewalls, top and bottom walls, an end wall and a door opposite said end wall, said door being in a frontal portion of said stove and said walls forming heat exchange surfaces, said bottom wall of said fire chamber sloping downwardly from the frontal portion of said stove to said end wall;

a frame positioned about said fire chamber and being spaced from said side, end, top and bottom walls of said fire chamber, said frame and fire chamber defining an air space therebetween;

an air inlet formed in said frame at the frontal portion of said stove for passing air from the exterior of said stove to said air space;

a fan disposed in said air space in front of and below said fire chamber for forcing air through said air space in a heat exchange path along the bottom, end and top walls of said fire chamber, said air being thereby heated, said fan being positioned in a relatively cool portion of said air space and wherein convection air flow in said air space causes a cool air from said inlet to flow about said fan, along said end wall and over said top wall to thereby prevent fan burn-out due to heat from said fire chamber; and an air outlet positioned in a frontal portion of said stove for passing said heated air from said air space to the exterior of said stove.

11. The stove of claim 10 further comprising vertical strips fixedly positioned on the inside of said fire chamber on the end wall thereof for keeping the fuel in said stove from abutting said end wall and blocking flames in said fire chamber from following said end wall to said top wall.

12. The stove of claim 10 wherein said stove further comprises a flue chamber extending over the top of said frame, said flue chamber having an inlet communicating with said fire chamber and an outlet communicating with a chimney of said existing fireplace, the hot exhaust gases from said fire chamber passing along the top surface of said frame and into said chimney through said outlet.

13. The stove of claim 12 wherein said flue chamber has a flat horizontal portion in heat exchange communication with the exterior of said stove, said flat horizontal portion being adapted to support cooking hardware.

14. The stove of claim 12 wherein said flue chamber has a flat horizontal portion in heat exchange communication with the exterior of said stove, said flat horizontal portion being positioned opposite to and spaced from said flue inlet to permit said hot exhaust gases to impinge thereon, and being adapted to support cooking hardware.

* * * * *